US007045749B2

(12) United States Patent
Kinouchi et al.

(10) Patent No.: US 7,045,749 B2
(45) Date of Patent: May 16, 2006

(54) APPARATUS FOR FIXING TONER ON TRANSFERRED MATERIAL

(75) Inventors: Satoshi Kinouchi, Tokyo (JP); Osamu Takagi, Tokyo (JP); Yoshinori Tsueda, Fuji (JP); Toshihiro Sone, Yokohama (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 18 days.

(21) Appl. No.: 10/805,514

(22) Filed: Mar. 22, 2004

(65) Prior Publication Data

US 2005/0205558 A1 Sep. 22, 2005

(51) Int. Cl.
*H05B 6/14* (2006.01)
*G03G 15/20* (2006.01)

(52) U.S. Cl. ..... 219/619; 219/671; 219/672; 399/328; 399/330

(58) Field of Classification Search ..... 219/619, 219/656, 662, 671, 672–676; 399/328–335
See application file for complete search history.

(56) References Cited

U.S. PATENT DOCUMENTS 6,078,781 A * 6/2000 Takagi et al. ..... 399/330
6,625,417 B1 9/2003 Terada et al.
6,630,651 B1 10/2003 Ohishi et al.
6,861,630 B1 * 3/2005 Kinouchi et al. ..... 219/661
2003/0002882 A1 * 1/2003 Takagi et al. ..... 399/69
2003/0219271 A1 11/2003 Kinouchi et al.
2004/0141038 A1 7/2004 Takagi et al.
2004/0173603 A1 9/2004 Kinouchi et al.
2004/0175211 A1 9/2004 Sone et al.
2004/0175212 A1 9/2004 Tsueda et al.
2004/0179874 A1 9/2004 Kinouchi et al.
2004/0184852 A1 9/2004 Takagi et al.

FOREIGN PATENT DOCUMENTS

JP 2002-34241 A 1/2002
JP 2002-222687 A 8/2002
JP 2003-86344 A 3/2003
JP 2003-215957 A 7/2003

OTHER PUBLICATIONS

U.S. Appl. No. 10/872,472, filed Jun. 22, 2004, Kinouchi et al.
U.S. Appl. No. 10/805,308, filed Mar. 22, 2004, Tsueda et al.

(Continued)

*Primary Examiner*—Philip H. Leung
(74) *Attorney, Agent, or Firm*—Foley & Lardner LLP

(57) ABSTRACT

The present invention relates to a device including a body to be heated to which a magnetic field is supplied to generate heat and which heats a developer on a material to be recorded, a plurality of coil bodies which generate an induced heat in the body to be heated from the outside of the body to be heated and which include litz wires having cross sections formed in rectangular shapes and which are disposed in a longitudinal direction of the body to be heated, and a pressure applying member which contacts the body to be heated in a predetermined position and which fixes the developer on the material to be recorded passing between the pressure applying member and the body to be heated.

16 Claims, 9 Drawing Sheets

OTHER PUBLICATIONS

U.S. Appl. No. 10/820,138, filed Apr. 8, 2004, Sone et al.
U.S. Appl. No. 10/805,305, filed Mar. 22, 2004, Sone et al.
U.S. Appl. No. 10/805,420, filed Mar. 22, 2004, Sone et al.
U.S. Appl. No. 10/799,770, filed Mar. 15, 2004, Kikuchi et al.
U.S. Appl. No. 10/805,507, filed Mar. 22, 2004, Kikuchi et al.
U.S. Appl. No. 10/805,522, filed Mar. 22, 2004, Kikuchi et al.
U.S. Appl. No. 10/806,392, filed Mar. 23, 2004, Takagi et al.
U.S. Appl. No. 10/807,428, filed Mar. 24, 2004, Kikuchi et al.
U.S. Appl. No. 10/807,366, filed Mar. 24, 2004, Wasai et al.

* cited by examiner

APPARATUS FOR FIXING TONER ON TRANSFERRED MATERIAL

BACKGROUND OF THE INVENTION

1. Field of the Invention

The present invention relates to a heating device using induction heating, particularly to a fixing device which is usable in a copying device or a printer device of an electrophotographic system using a hot-melting developer and which fixes the developer on a recording object.

2. Description of the Related Art

In a fixing device incorporated in a copying device using an electrophotographic process, a toner (developer) formed on a material to be fixed (recording material) is heated and molten to fix the toner on the recording material. In recent years, induction heating has been broadly used as a heating system capable of reducing heating time which is a time from a time when power supply is started until temperature reaches a fixable temperature. However, in induction heating, it is known that an interference sound is generated in a case where there are a plurality of coils as magnetic flux generation device and frequencies of powers supplied to individual coils differ. When a heating object is a roller body, it is difficult to maintain a certain distance between each coil and the roller body. It is also known that the coil is disposed along the peripheral surface of the roller body in order to maintain a certain distance between each coil and the roller member, and it is accordingly difficult to keep a certain magnetic flux density.

For example, in Jpn. Pat. Appln. KOKAI Publication Nos. 2003-86344 and 2003-215957, an attempt is described to increase a space (spatial distance) between the roller body which is the heating object and each electric wire of the coil used in a heating device while securing a magnetic flux density capable of reaching the roller body.

For example, in Jpn. Pat. Appln. KOKAI Publication No. 2002-222687, it is described that a magnetic flux distribution adjustment member is disposed to compensate for the magnetic flux density decreasing when each electric wire of the coil body of a heating device is disposed along the peripheral surface of the roller member as the heating object.

For example, in Jpn. Pat. Appln. KOKAI Publication No. 2002-34241, it is proposed that two systems of circuits for supplying powers to a plurality of coil bodies are disposed. In a first circuit, a time for supplying the power to the coil body connected to the first circuit is changed. In a second circuit, the power is supplied to the coil body connected to the second circuit at the same frequency as that for use in the first circuit for a period for which no power is supplied to the coil body connected to the first circuit.

However, even by any of the proposals described in the above-described documents, the temperature of the roller body which is the heating object is not uniformed in a whole region of the roller body in a longitudinal direction. Moreover, in a method of supplying the powers having different frequencies to the coils using a plurality of coil bodies, reduction of the interference sound is not realized while reducing cost required for a circuit which supplies the powers.

BRIEF SUMMARY OF THE INVENTION

An object of the present invention is to provide a fixing device in which heating rises quickly (time from when power supply is started until temperature reaches a fixable temperature is short) and which is capable of stably fixing toner on a recording material.

In the invention, there is provided a heating device comprising:

a body to be heated to which a magnetic field is supplied to generate heat and which heats a developer on a material to be recorded;

first and second coil bodies which generate an induced heat in the body to be heated from the outside of the body to be heated, a plurality of first and second coil bodies being disposed in a longitudinal direction of the body to be heated, the first and second coil bodies including litz wires whose cross sections are formed in rectangular shapes; and a pressure applying member which contacts the body to be heated in a predetermined position and which fixes the developer on the material to be recorded passing between the pressure applying member and the body to be heated.

Moreover, in the invention, there is provided a heating device comprising:

a body to be heated to which a magnetic field is supplied to generate heat and which heats a developer on a material to be recorded;

first and second coil bodies which generate an induced heat in the body to be heated from the outside of the body to be heated, a plurality of first and second coil bodies being disposed in a longitudinal direction of the body to be heated, the first and second coil bodies including litz wire comprising a plurality of intertwined wires;

a pressure applying member which contacts the body to be heated in a predetermined position and which fixes the developer on the material to be recorded passing between the pressure applying member and the body to be heated;

a housing with which at least a part of the body to be heated is covered;

a second housing with which at least a part of the pressure applying member is covered;

sound absorbing materials which are disposed in predetermined positions of the housing and the second housing and which absorb sound generated in a case where driving signals having different frequencies are supplied to the first and second coil bodies; and a sound insulating member which is disposed in a predetermined position of at least one of the housing and the second housing and which attenuates sound generated in a case where the driving signals having different frequencies are supplied to the first and second coil bodies.

Furthermore, in the invention, there is provided a fixing device comprising:

a body to be heated including a central axis, an elastic body formed in a predetermined thickness around the central axis, a conductive layer formed in a predetermined thickness around the elastic body, and a second elastic body formed in a predetermined thickness around the conductive layer to generate heat by supply of a magnetic field, so that a developer on a material to be recorded is heated;

first and second coil bodies to supply predetermined magnetic fields so that the conductive layer of the body to be heated is capable of generating heat from the outside of the body to be heated, a plurality of first and second coil bodies being disposed in a longitudinal direction of the body to be heated, the first and second coil bodies including litz wires whose cross sections are formed in rectangular shapes;

a pressurizing member which is disposed along the central axis of the body to be heated and which supplies a pressure toward the central axis or a predetermined position of the body to be heated to deform the elastic body by a predetermined amount;

a housing with which at least a part of the body to be heated is covered;

a second housing with which at least a part of the pressurizing member is covered;

sound absorbing materials which are disposed in predetermined positions of the housing and the second housing and which absorb sound generated in a case where driving signals having different frequencies are supplied to the first and second coil bodies; and a sound insulating member which is disposed in a predetermined position of at least one of the housing and the second housing and which attenuates sound generated in a case where the driving signals having different frequencies are supplied to the first and second coil bodies.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be described with reference to the drawings.

Figure 1:
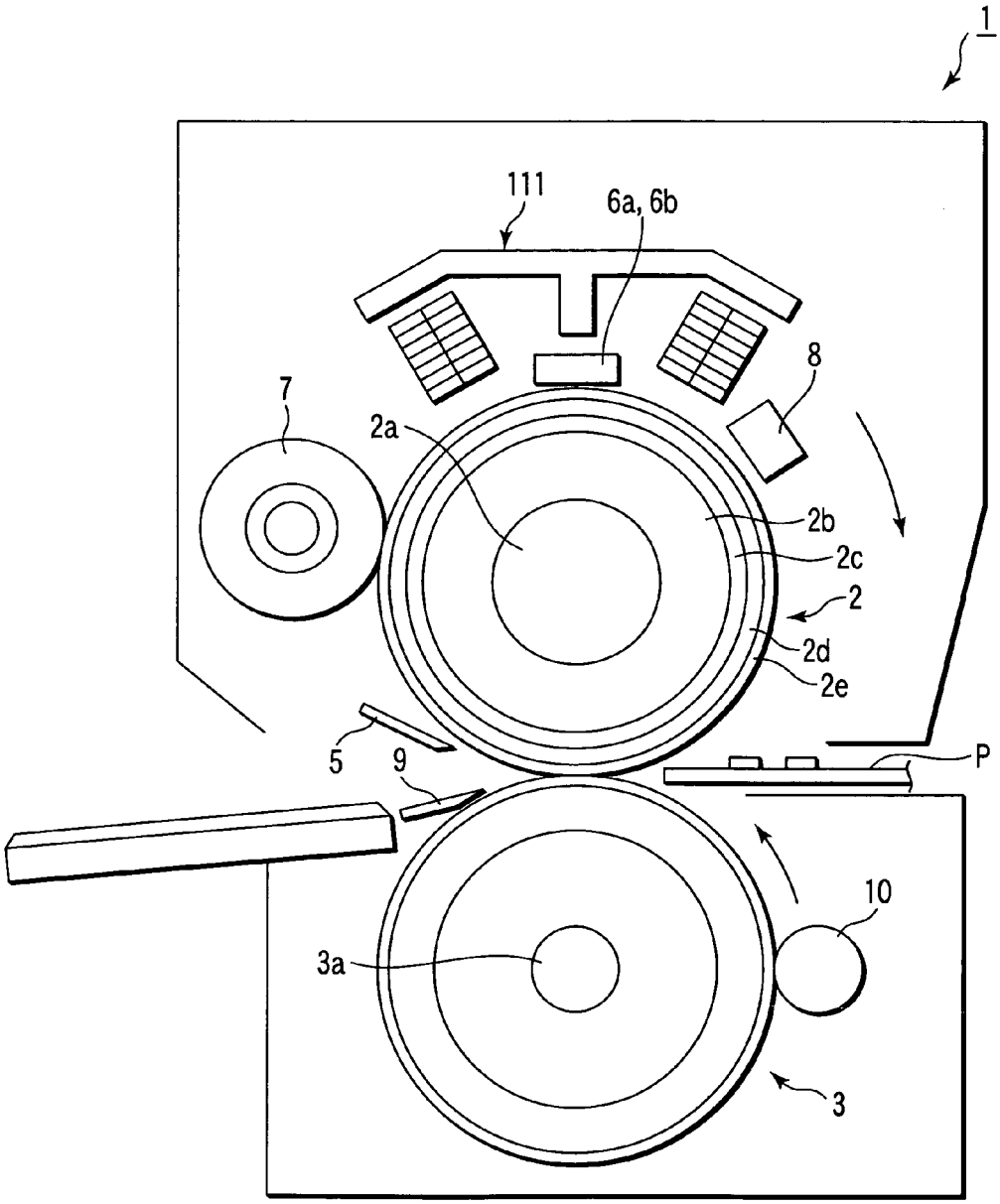
FIG. 1 is a schematic diagram showing an example of a fixing device to which an embodiment of the present invention is applied.

FIG. 1 is a schematic diagram showing an example of a fixing device to which an embodiment of the present invention is applied.

As shown in FIG. 1, a fixing device 1 includes a heating roller 2 having a diameter of approximately 40 mm, a pressurizing roller 3 having a diameter of approximately 40 mm, and a heating device 111.

The heating roller 2 has a cylindrical shape in which a core metal 2*a*, an elastic layer 2*b* formed of a rubber foam or sponge, a metal conductive layer 2*c*, an elastic layer 2*d* formed of a solid rubber, and a mold release layer 2*e* are disposed in order from the center. It is to be noted that the elastic layer 2*b* has a thickness of 5 mm, the metal conductive layer 2*c* has a thickness of 40 μm, the elastic layer 2*d* has a thickness of 200 μm, and the mold release layer 2*e* has a thickness of 30 μm. The metal conductive layer 2*c* is, for example, of nickel (Ni). As a material of the metal conductive layer 2*c*, stainless steel, aluminum, a composite material (alloy) of stainless steel and aluminum or the like is usable.

The pressurizing roller 3 is an elastic body in which a periphery of a core metal 3*a* formed, for example, of a metal is coated with silicon rubber or fluorine rubber. The pressurizing roller 3 is pressed onto the heating roller 2 by a pressurizing mechanism 4 with a predetermined pressure in a state in which an axial line (of the core metal 3*a*) is disposed substantially parallel to the axial line (core metal) of the heating roller 2. Accordingly, a nip (fixing region) is applied in a position contacting the outer peripheral surface of the heating roller 2. The pressurizing roller 3 has the same inner structure as that of the heating roller 2.

The heating roller 2 is rotated in an arrow direction, when a driving power of a driving motor (not shown) is supplied by a power transmission mechanism (not shown). Therefore, the pressurizing roller 3 is driven and rotated in an arrow direction. The elastic layer 2*b*, metal conductive layer 2*c*, elastic layer 2*d*, and mold release layer 2*e* of the heating roller 2 are elastically deformed by the pressure from the pressurizing roller 3 in the nip portion which contacts the pressurizing roller 3. Therefore, predetermined pressures are applied to a sheet P conveyed into a nip portion between the pressurizing roller 3 and the heating roller 2 and a developer material, that is, toner electrostatically held by the sheet.

On the outer peripheral surface of the heating roller 2, a peeling claw 5, thermistors 6 (two or more thermistors are disposed in the longitudinal direction of the heating roller 2, and hereinafter referred to as thermistors 6*a*, 6*b*), a cleaning member 7, a thermo stud 8 and the like are arranged along the direction in which the roller 2 is rotated using the nip portion as a reference. The peeling claw 5 peels a sheet (recording material) P guided by the nip portion from the heating roller 2. The peeling claw 5 may also be omitted. The thermistor 6 detects the temperature of the heating roller 2. The cleaning member 7 removes power and the like generated from the toner or the sheet P fixed to the surface (outer peripheral surface) of the heating roller 2. The thermostat 8 detects abnormality of the surface temperature of the heating roller 2 to interrupt the supply of the power to a heating device 100. The thermistor 6 or the thermostat 8 is disposed in a position which is not influenced by magnetic force lines generated from the heating device 100, that is, a magnetic flux generation device represented by a coil for generating magnetic flux.

A peeling claw 9 and a cleaning roller 10 are disposed along a direction in which the roller 3 is rotated using the nip portion as the reference on the outer peripheral surface of the pressurizing roller 3. The peeling claw 9 peels the sheet P from the roller 3. The peeling claw 9 may also be omitted. The cleaning roller 10 removes the powder and the like generated from the toner and sheet (recording material) attached to the roller 3 surface.

Figure 2:
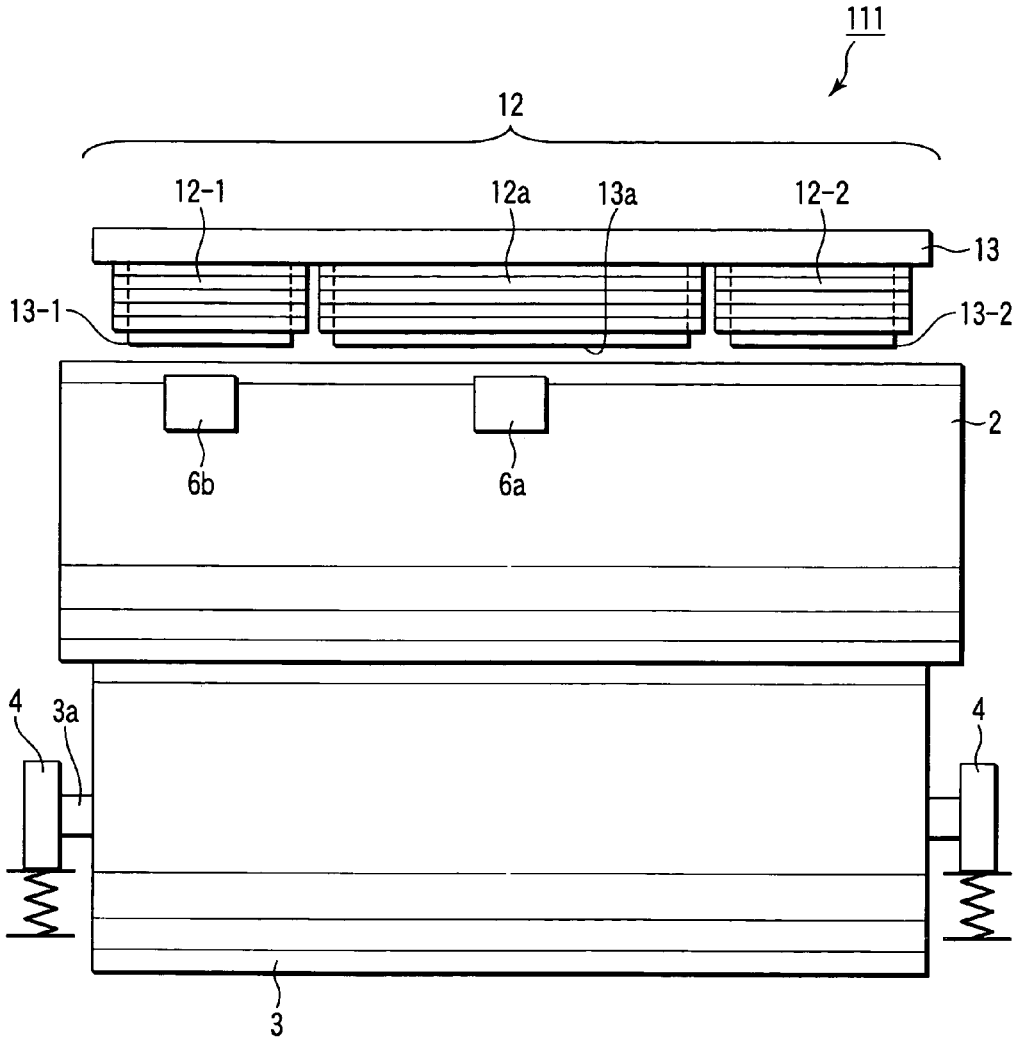
FIG. 2 is a schematic diagram showing an example of a constitution of a heating device incorporated in the fixing device shown in FIG. 1.

FIG. 2 shows an example of a constitution of the heating device incorporated in the fixing device shown in FIG. 1, The heating device 111 includes a coil 12 which supplies a magnetic field to the metal conductive layer 2*c* of the heating roller 2 (or the pressurizing roller 3). The coil 12 is laminated in a predetermined configuration including a core 13 formed of a magnetic body.

As shown in FIG. 2, the coil 12 is divided, for example, into three along the longitudinal direction of the heating roller 2. The coils other than a center coil 12*a* are operated by the same control. That is, coils 12-1, 12-2 on opposite end portions are constantly simultaneously operated. The coil 12 is divided into the center coil 12*a*, and the coils 12-1, 12-2 on the opposite end portions. Accordingly, the temperature distribution of the heating roller 2 in the longitudinal direction can be uniformed on conditions that a width is reduced as compared with conveyance of a sheet having an A3 size, represented by a condition that a short side of the sheet having an A4 size crosses a conveying direction at right angles in conveying the sheet P. This coil for supplying the power is independently controlled.

Figure 3:
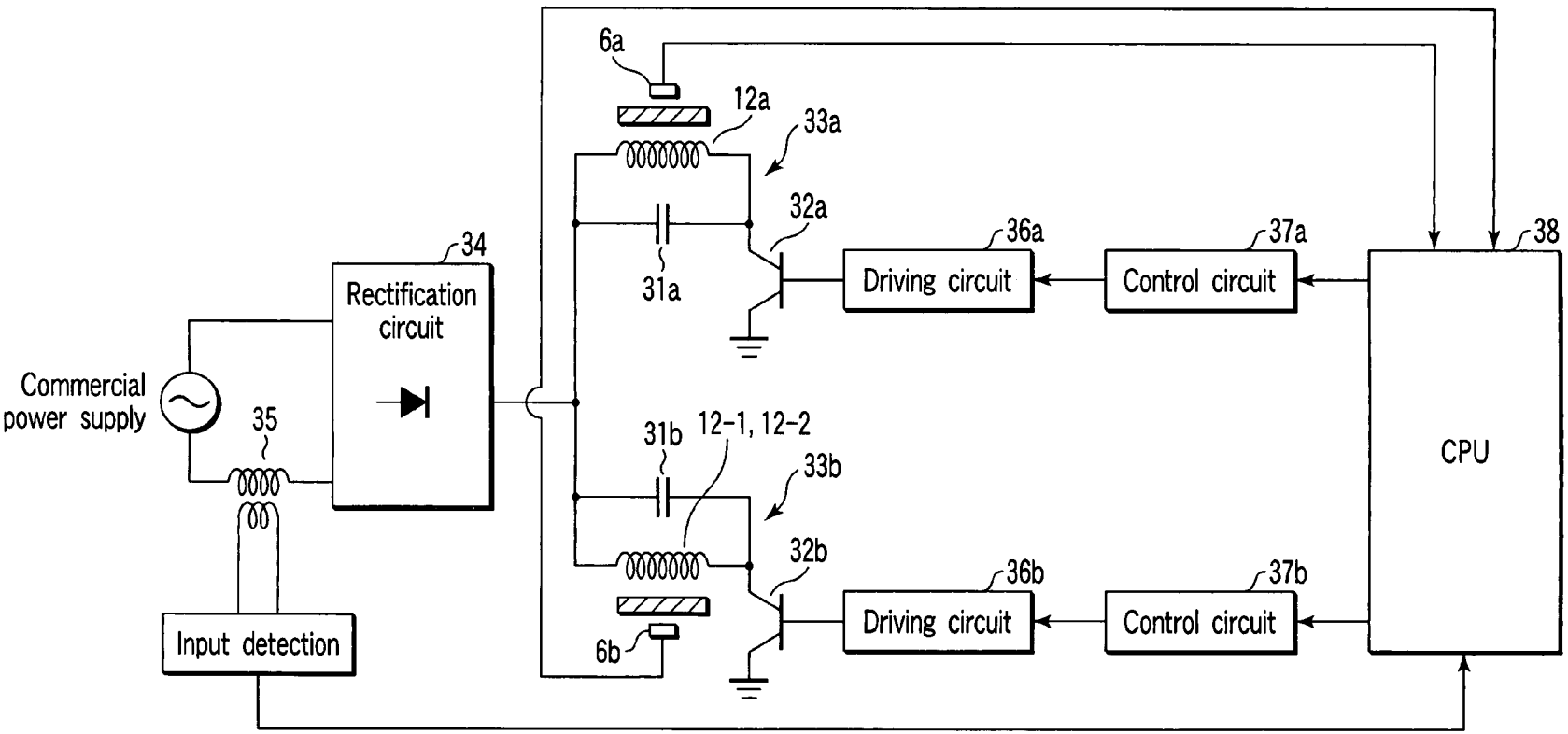
FIG. 3 is a schematic diagram showing an example of a driving circuit (temperature control circuit) which operates the fixing device shown in FIGS. 1 and 2.

FIG. 3 shows an example of a driving circuit (temperature control circuit) which operates the fixing device shown in FIGS. 1 and 2.

Capacitors 31*a*, 31*b* for resonance are connected in parallel with the coils 12, that is, the center coil 12*a* and the coils 12-1, 12-2 on the opposite end portions. Switching elements 32*a*, 32*b* are connected to a set of the coil 12*a* and capacitor 31*a* and a set of the coils 12-1, 12-2 and capacitor 31*b*. In the switching elements 32*a*, 32*b*, an insulated gate bipolar transistor (IGBT) having a high withstand voltage and capable of supplying a current of about 100 amperes (A), a field effect transistor (MOS-FET) and the like are usable. A first inverter circuit 33*a* is defined by the center coil 12*a*, capacitor 31*a*, and switching element 32*a*, and a second inverter circuit 33*b* is defined by the opposite end portion coils 12-1 and 12-2, capacitor 31*b*, and switching element 32*b*.

A direct current obtained by smoothing a commercial alternating-current power supply by a rectification circuit 34 is supplied to each inverter circuit. A transformer 35 which makes possible detection of all power consumption is disposed in a front stage of the rectification circuit 34.

Control terminals of the switching elements 32*a*, 32*b* are connected to driving circuits 36*a*, 36*b* for applying predetermined driving voltages to the corresponding control terminals of the switching elements to turn ON the respective switching elements. Operation timings of the driving circuits 36*a*, 36*b* are directed by control circuits 37*a*, 37*b*. Optional frequencies (capable of setting output powers), for example, in a range of 20 to 60 kHz are directed to the driving circuits 36*a*, 36*b* by the control circuits 37*a*, 37*b* in order to control a time for turning ON the respective switching elements 32*a*, 32*b*.

The thermistors 6 (hereinafter referred to as 6*a*, 6*b* for the description) are disposed at predetermined positions on an outer periphery of a material to be heated (the heating roller 2 in the present embodiment) by the coils 12*a*, 12-1, 12-2, and a temperature detection signal (voltage value) of a region facing the heating roller 2 is input into a CPU 38 from the respective thermistors 6*a*, 6*b*.

Commands indicating the coil to be operated (to which the power is to be supplied) or indicating whether or not the power supply to all the coils is OFF are directed to the control circuits 37*a*, 37*b* from the CPU 38 in accordance with the voltage values output from the thermistors 6*a*, 6*b*. For example, a control system is usually used in which when the power is supplied to a certain coil, no power is supplied to the other coil (turned OFF). However, both the coils may also be simultaneously driven (the power is simultaneously supplied to both the coils. The example of FIG. 3 shows a quasi E-class circuit in which only one switching element is used as an inverter circuit for driving (supplying the power to) the coil (12*a* or either of 12-1 and 12-2 in the set). However, a half bridge type circuit may also be used in which the switching elements are allocated to the individual inverter circuits and outputs are adjusted by a pulse width modulation (PWM) control.

Figure 4A:
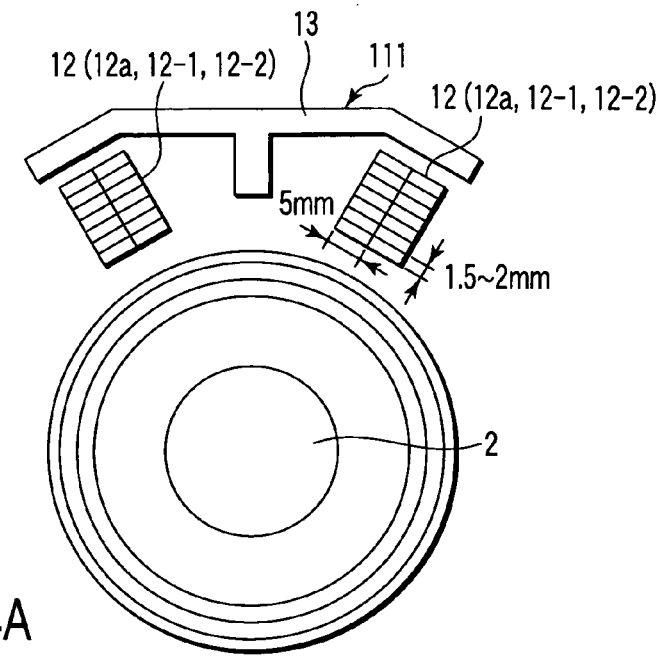
FIG. 4A is a schematic diagram showing characteristics of a configuration of a coil incorporated in the heating device shown in FIG. 2.

FIG. 4A shows characteristics of a configuration of the coil incorporated in the heating device. The coil 12 shown in FIG. 4A is formed, for example, by a bunch of 16 litz wires each comprising a coated copper wire material having a electric wire (conductor) diameter of 0.5 mm. A coating material is, for example, polyamide imide.

By the use of the litz wires, when an alternating-current power having a high frequency is supplied, a ratio of a linear diameter to a penetration depth can be reduced, and it is possible to effectively pass the alternating current (an influence of "surface effect" which raises a problem in passing an alternating current having a high frequency can be suppressed).

A sectional shape of the litz wire is substantially tetragonal for a purpose of enhancing a mounting density. It is to be noted that the sectional shape is easily obtained by molding the litz wire, for example, by press working. Since the cross section is formed in the tetragonal (rectangular) shape, a dead space made between adjacent electric wires can be reduced, and further a distance between a wire material positioned most distant from an outer periphery of the roller 2 and the metal conductive layer 2*c* (roller 2). It is to be noted that the number of turns of coil (arrangement and lamination) is two turns (rows) in a direction along the peripheral surface of the roller 2, and seven turns (layers) in a direction distant from the peripheral surface of the roller 2. That is, considering the relation between the number of rows of coils along the peripheral surface of the roller and the number of laminates in a radius direction, the embodiment is characterized in that the number of laminates is larger than the number of rows.

Moreover, in the present embodiment, in a horizontal to vertical ratio of the tetragonal section of the litz wire, the length of the wire facing (extending along) the outer periphery of the heating roller 2 is set to be larger than the length (thickness) of the roller 2 in the radius direction. In an example, the length of the roller 2 in a peripheral direction is 5 mm, and the length (thickness) of another side is 1.5 to 2 mm.

By the characteristic of the configuration, the amount of magnetic flux (magnetic force lines) reaching the metal conductive layer 2*c* of the roller 2 (roller 2) is increased as compared with an example in which litz wires each having a circular section are laminated.

In an example, when the cross sections of 0.5 mm×16 litz wires are formed simply in circular shapes, the diameter is approximately 2.8 mm. This is approximately twice a thickness of the present wire material having a rectangular section described above (length of the roller 2 in the radius direction). The thickness is 1.5 mm.

Moreover, the distance between the wire material positioned most distant from the roller 2 and the roller surface is 1.5×7=10.5 mm in a case where the litz wires having the rectangular sections in the present invention are used in seven layers. When the litz wires having the circular sections are used in seven layers, the distance is 2.8×7=19.6 mm.

Figure 4B:
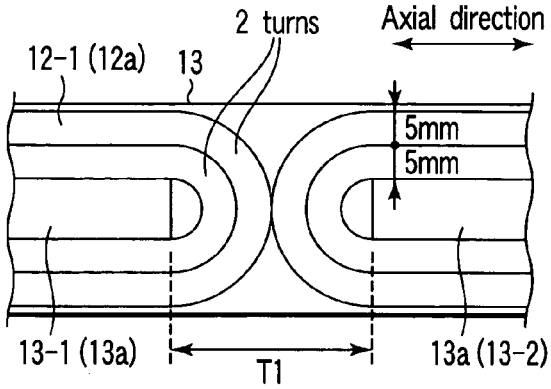
FIG. 4B is a schematic diagram showing the characteristics of the configuration of the coil incorporated in the heating device shown in FIG. 2 as viewed from a core side of the heating device.
Figure 4C:
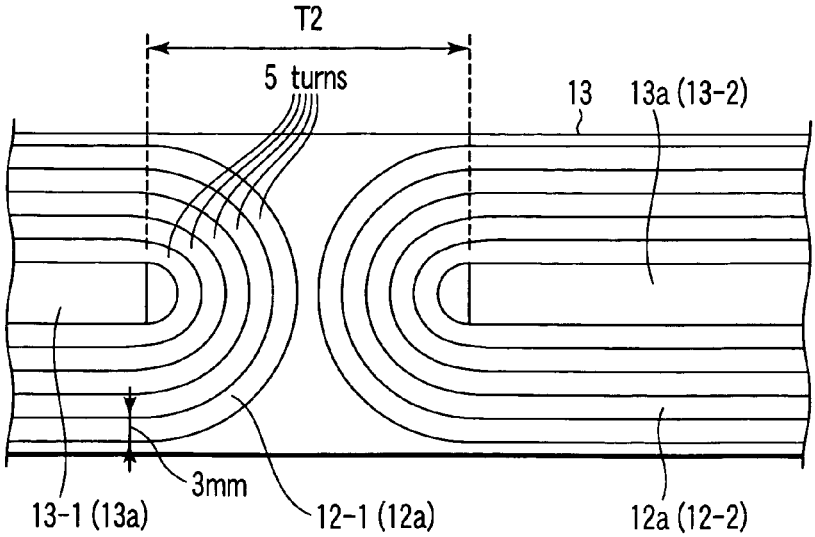
FIG. 4C is a schematic diagram showing the characteristics of a general coil configuration as compared with the heating device shown in FIG. 4B in a state viewed from the core side of the heating device.

By the use of the coil configuration of the present embodiment, there are the following merits:

(1) since the number of turns on a side facing the cylindrical surface of the roller is two, and is small, it is easy to manage the distance between the cylindrical surface of the roller and the coil;

(2) since a region of the cylindrical surface of the roller covered with the coil is small, the cleaning member is easily disposed on the outer periphery of the roller;

(3) the coil can be miniaturized; and (4) since two turns (linear width 5 mm×2) are disposed even in the end portion of the coil as shown in FIG. 4B, a temperature drop is small as compared with an example (linear diameter 3 mm×5) in which the coil having a general configuration is used as shown in FIG. 4C for comparison.

It is to be noted that (4) will be described in more detail. In the heating device 111 including a plurality of coils arranged along the axial direction of the heating roller 2 as shown in FIG. 2, the distances of cores 13*a*, 13-1, 13-2 disposed facing the individual coils 12*a*, 12-1, 12-2 are determined depending on the number of turns of the coil and the linear diameter (linear width) of the coil as apparent from the present embodiment shown in FIG. 4B and a comparative example shown in FIG. 4C. That is, as shown in FIG. 4B, in the present embodiment, a distance $T_1$ between the cores dominated by the number of turns of coils and the linear width is shorter than a distance $T_2$ between the cores in the comparative example shown in FIG. 4C. Therefore, it is well known that the temperature of the surface of the heating roller 2 facing between the coils has a temperature difference in the axial direction in the case where a plurality of coils are arranged in the axial direction of the heating roller 2 for use. However, the temperature difference can be reduced in the arrangement shown in FIG. 4B as compared with the arrangement shown in FIG. 4C.

On the other hand, as described with reference to FIGS. 2 and 4A, the coil 12 is divided into the center coil 12*a* and end portion coils 12-1 and 12-2, and any coil can be easily disposed along the outer peripheral surface of the roller. That is, the distance between each coil and the outer peripheral surface of the roller can be reduced. By the use of the core 13 (13*a*, 13-1, 13-2), magnetic fluxes generated from the individual coils are prevented from constituting magnetic fluxes that do not contribute to heat generation on the roller 2 surface. That is, a loss of the magnetic flux can be suppressed (by the use of the core, an effect of compensating for the magnetic flux incurring the loss can be obtained. As a result, a degree of the drop of the temperature of the roller 2 is reduced. Furthermore, since the individual coils to be laminated may be arranged vertically to a normal direction of the cylindrical surface of the roller, a restriction on the configuration of the coil is also reduced.

In other words, there are the following merits:

(5) since the coil turn (row) number along the cylindrical surface of the roller is small, a degree of freedom in molding the coil is enhanced;

(6) the drop of the magnetic flux capable of reaching the metal conductive layer of the roller by a large number of coil turns (layers) in a direction distant from the roller is considered, but by reduction of the thickness of the coil, it is possible to cancel an influence by the increase of the layer number; and (7) since the coil can be disposed along the peripheral surface of the roller, the adjacent coils can be prevented from canceling out the magnetic flux, and, as a result, the individual coils can be arranged in the vicinity of the peripheral surface of the roller.

As described above, a coil body can be obtained in which the shape of the single coil can be miniaturized and the coil can be easily molded.

Moreover, a temperature drop between the coils (joint) caused by division of the coil 12 into a plurality of coils in the longitudinal direction of the roller 2 can be minimized.

Figure 5:
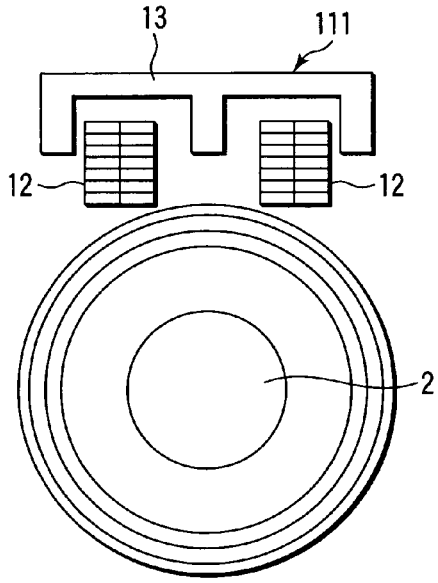
FIG. 5 is a schematic diagram showing another characteristic of the configuration of the coil incorporated in the heating device shown in FIG. 2.

It is to be noted that, for example, as shown in FIG. 5, the coils 12 may also be arranged vertically to the peripheral surface of the roller 2 as long as it is possible to obtain a necessary output. The number of turns (rows) of coils extending along the peripheral surface of the heating roller 2 may also be larger than two turns, and conversely only one turn is also possible.

Figure 6:
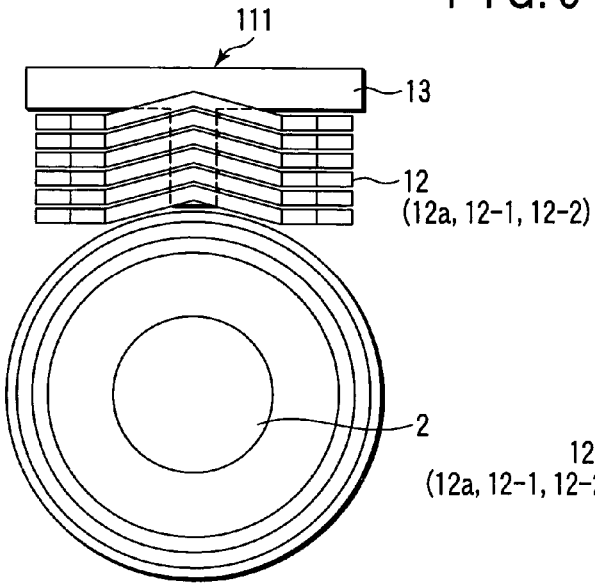
FIG. 6 is a schematic diagram showing still another characteristic of the configuration of the coil incorporated in the heating device shown in FIG. 2.

Moreover, for example, as shown in FIG. 6, the coil 12 may also be bent (deformed) on the peripheral surface side of the roller 2 so that the distance between the end portion of the coil 12 in the peripheral direction of the roller 2 and the peripheral surface of the roller 2 is reduced in a state in which an arrangement mode of the coil vertical to the peripheral surface of the roller 2 is maintained (a substantial distance between the coil 12 and the roller 2 is reduced). It is to be noted that by the arrangement of the wire materials (rectangular litz wires) of the coil 12 shown in FIG. 6, the distance between the coil and (the peripheral surface of) the roller can be prevented from increasing greatly even with the use of the coils distant from one another in a direction along the peripheral surface of the roller 2.

Figure 7:
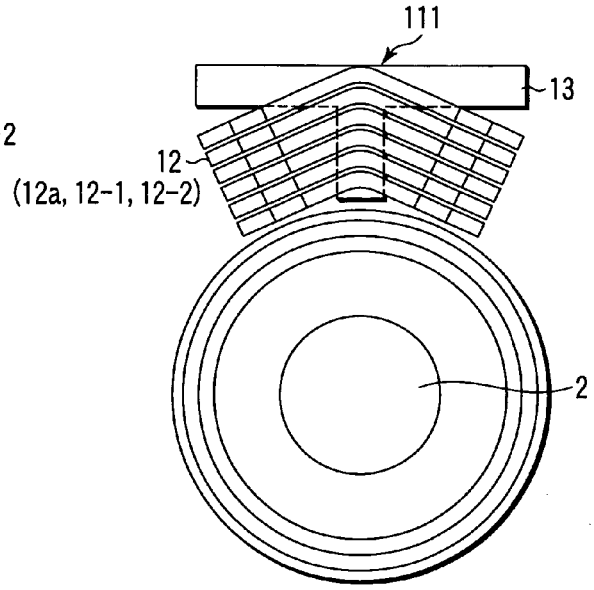
FIG. 7 is a schematic diagram showing still another characteristic of the configuration of the coil incorporated in the heating device shown in FIG. 2.

Furthermore, in the coil 12, for example, as shown in FIG. 7, the coil 12 may also be deformed in an optional position so as to extend in a normal direction of the roller in the peripheral surface of the roller 2 (the substantial distance between the coil 12 and the roller 2 is reduced). It is to be noted that by the arrangement of the wire materials (rectangular litz wires) of the coil 12 shown in FIG. 6, the distance between the coil and (the peripheral surface of) the roller can be prevented from increasing greatly even with the use of the coils distant from one another in the direction along the peripheral surface of the roller 2.

Figure 8:
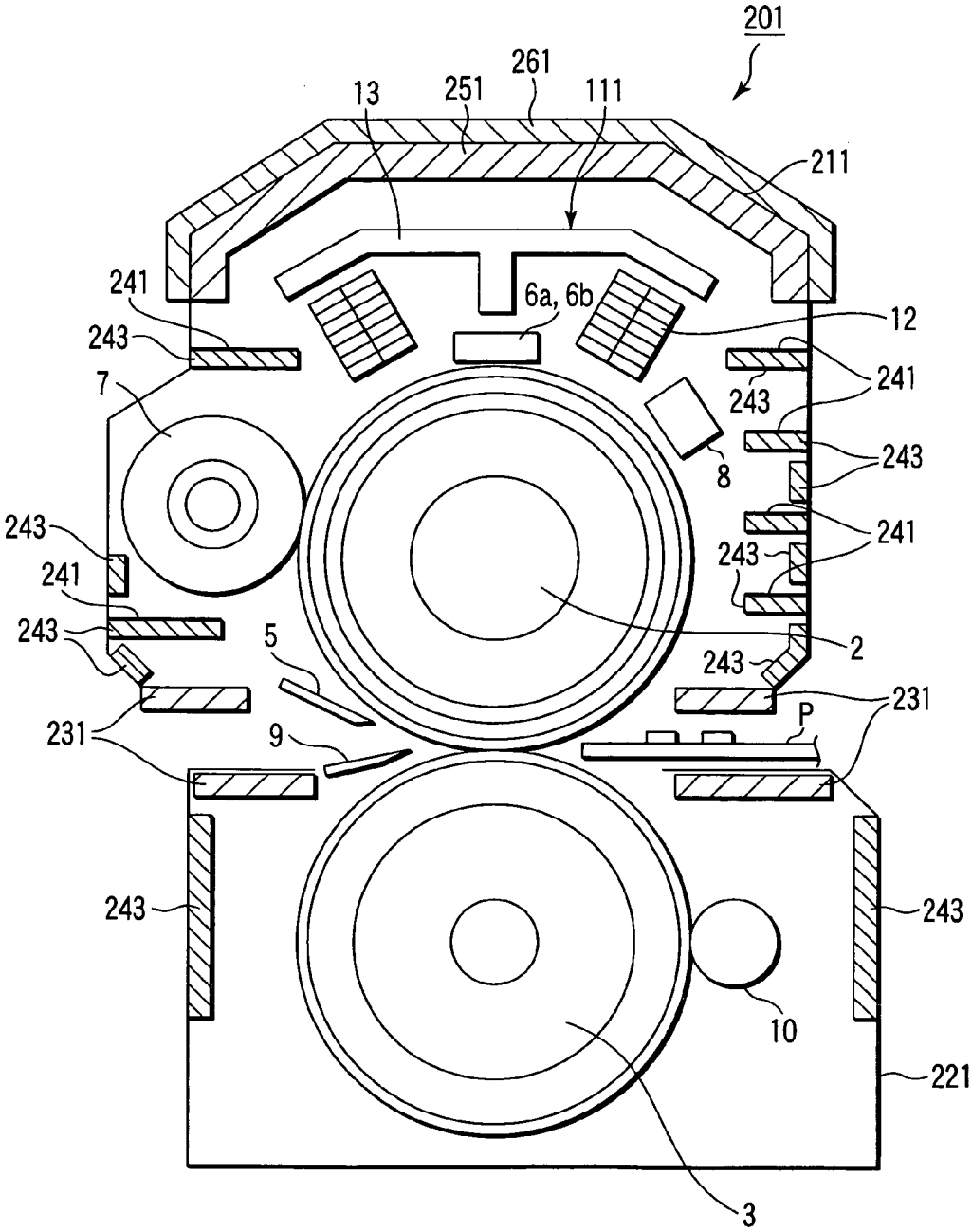
FIG. 8 is a schematic diagram showing another embodiment of the fixing device shown in FIG. 1.

FIG. 8 is a schematic diagram showing another embodiment of the fixing device shown in FIG. 1. It is to be noted that a constitution identical or similar to that shown in FIG. 1 is denoted with the same reference numerals, and detailed description is omitted.

A fixing device 201 includes the heating roller 2, pressurizing roller 3, and heating device 111.

The heating roller 2 and heating device 111 are stored in a housing (upper) 211. The pressurizing roller 3 is stored in a housing (lower) 221.

A plurality of sound absorbing materials 231 which attenuate interference sounds and which reduce leakage of the interference sounds to the outside are disposed in a region where the housing (upper) 211 and/or the housing (lower) 221 are interrupted, that is, an opening for use in conveying the sheet P, and in the vicinity of the nip portion in which the heating roller 2 contacts the pressurizing roller 3. Ribs (sound insulating walls) 241 to prevent the interference sound generated in a case where the frequencies of the powers supplied to the three divided coils 12, that is, the center coil 12*a* and end portion coils 12-1 and 12-2 differ from leaking to the outside from the vicinity of the nip portion and sound absorbing materials 243 to absorb the interference sound are disposed in predetermined positions of the housing (upper) 211 and housing (lower) 221.

In the sound absorbing materials 231 and 243, glass wool having high resistance to heat is usable. It is to be noted that in a portion having little temperature rise, for example, in a sound absorbing material 251 disposed in a region outside the core 13 of the heating device 111 in the housing (upper) 211, an inexpensive urethane rubber (e.g., Sinserate [trade name]) or the like having a resistant temperature lower than that of glass wool is also usable. The sound absorbing materials 231, 243, and 251 may be disposed outside the housings 211, 221. The sound absorbing materials 231, 243, and 251 may also be arranged in holes (openings) or dents or the like disposed in the predetermined regions of the housings 211, 221.

Moreover, the interference sound comparatively easily leaks to the outside in the vicinity of the opening for the sheet guided into/discharged from the nip portion. Therefore, the sound absorbing materials 231 are preferably disposed in the vicinities of the heating roller 2 and pressurizing roller 3.

It is to be noted that results of consideration with respect to magnitude of the interference sound is shown in Table 1 as follows.

TABLE 1

| Varnish treatment for coil | Sound absorption of sheet supply section | Inner sound proof cover | Exterior cover | Frequency (Hz) | Sound pressure (dB) |
|---|---|---|---|---|---|
| ○ | ○ | ○ | ○ | 9150 | 18.2 |
| ○ | X | ○ | ○ | 9000 | 20.4 |
| ○ | ○ | X | ○ | 9100 | 21.2 |
| ○ | X | X | ○ | 9150 | 24.8 |
| ○ | X | X | ○ | 8800 | 29.3 |
| X | X | X | ○ | 8500 | 42.7 |
| X | X | X | X | 8400 | 46.2 |

Varnish treatment: the coil is fixed with a heat-resistant adhesive (varnish);

Sound absorption treatment of a sheet supply section:

A sound absorbing material having a length of 5λ/8 is disposed in the opening;

$$\lambda = C/f = 340\times10^3/8\times10^3 = 42.5 \text{ mm};$$

C: sound velocity, f: interference frequency, assuming f=8 kHz, 5λ/8=26.5 mm;

Sound absorbing material (231): heat-resistant materials such as glass wool and urethane rubber;

the material may also be Sinserate (trade name);

Cover member (261): formed of iron.

Table 1 shows a frequency (second item from the right of Table 1) at which a sound volume (sound pressure) is maximized and the magnitude (right item of Table 1, unit of [dB]) in interference sounds generated in: a case where the electric wire materials for use in the individual coils 12*a*, 12-1, 12-2 are fixed to one another, for example, by varnish in a state in which the cover member 261 is not disposed (left item of Table 1); a case where the sound absorbing materials 231 are disposed in addition to the wire material fixed by varnish (second item from the left of Table 1); and a case where the sound absorbing materials 243 (251) are disposed in addition to the wire material fixed by varnish (third item from the left of Table 1). It is to be noted that a fourth item from the left of Table 1 shows the frequency and magnitude of the interference sound in the case where the cover member 261 is further disposed in addition to the wire material fixed by varnish. When the cover member 261 is formed of a resin, the interference sound can be further prevented from leaking to the outside. In this case, for example, an ABS resin or the like is usable as the cover member 261.

Figure 9:
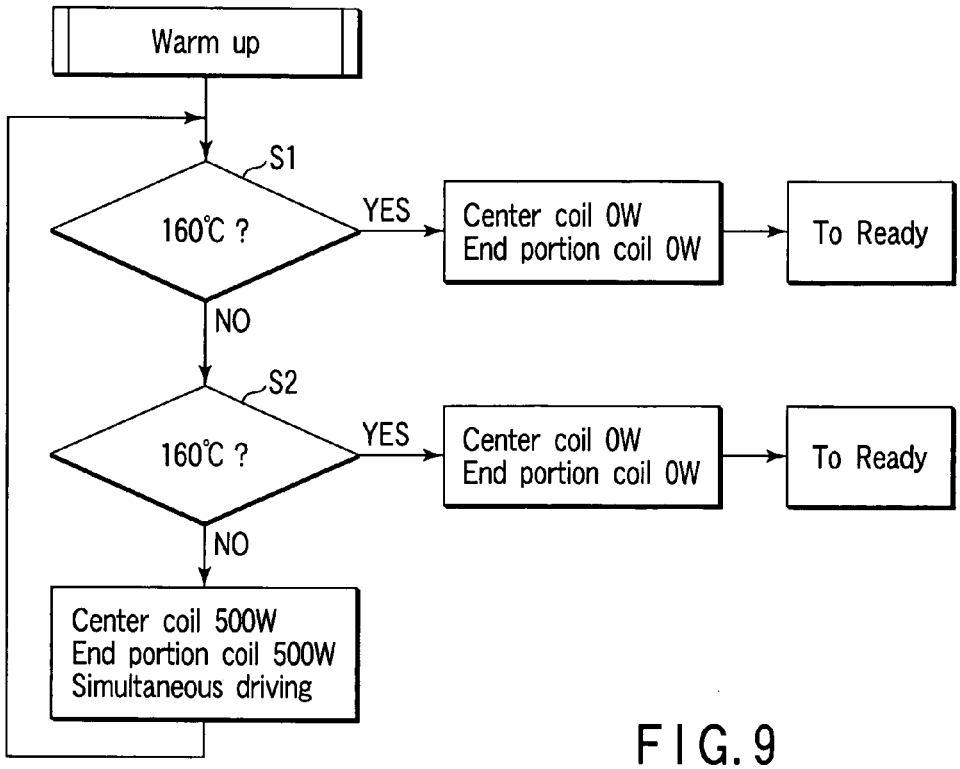
FIG. 9 is a schematic diagram showing an example of power supply control capable of reducing an interference sound in the fixing device shown in FIG. 8 (at a warm-up time)

FIG. 9 is a schematic diagram showing an example of power supply control capable of reducing the interference sound in the fixing device shown in FIG. 8.

As described above with reference to FIG. 8, the interference sound generated in a case where the frequencies of the powers supplied to the divided coils 12, that is, the center coil 12*a* and end portion coils 12-1 and 12-2 differ can be reduced by the sound absorbing material and sound insulating wall.

However, to supply the power having a predetermined frequency to an optional coil set, that is, the center coil 12*a* or the set of the end portion coils 12-1 and 12-2, selective power supply in which the power is supplied to either coil (hereinafter referred to as first control method A), and simultaneous power supply in which the power is simultaneously supplied to at least two optional coils in the coil set (hereinafter referred to as second control method B) are switched in accordance with an operation state of an image forming device (not shown). Accordingly, the interference sound is inhibited from being generated, and a level (sound volume=magnitude) of the interference sound can be further reduced.

For example, during a warming-up time by power conduction (commercial power supply ON) to the image forming device (not shown), predetermined powers are supplied to the individual coils by the second control method B in which the powers are simultaneously supplied to all the coils. For example, voltages or currents having predetermined frequencies are supplied to the center coil 12*a* and the end portion coils 12-1 and 12-2 in such a manner that a heat output is approximately 500 W (1 kW in total) (see. FIG. 9).

That is, in steps S1 and S2, it is continuously monitored whether or not the temperature of any region of the roller 2 has reached 160° C. The power supply is continued by the second control method B until the temperature of the surface of the corresponding roller 2 reaches 160° C. in at least one of thermistors 6*a*, 6*b*. It is to be noted that a total power inputtable into each coil can be supplied in the second control method B.

Figure 10:
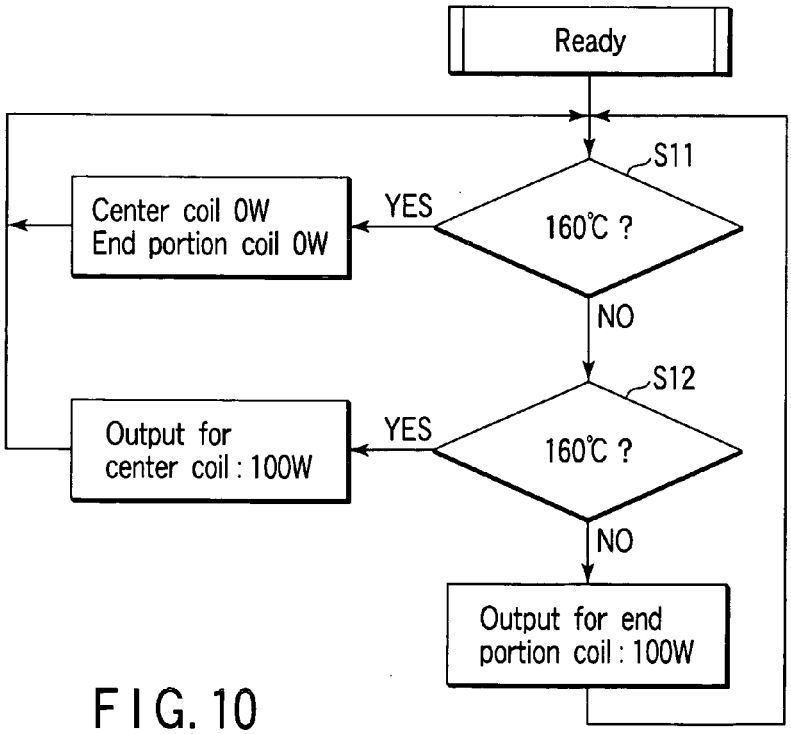
FIG. 10 is a schematic diagram showing an example of the power supply control capable of reducing the interference sound in the fixing device shown in FIG. 8 (at a ready time)

When it is detected in either of the steps S1 and S2 that the temperature of the predetermined position of the roller 2 has reached 160° C., the process is switched to a conduction control in a ready state shown in FIG. 10.

In the ready state (on standby), as shown in FIG. 10, while the temperature of the heating roller 2 is detected by the thermistors 6*a*, 6*b*, the predetermined power is supplied to the set of coils, that is, 12*a* or 12-1, 12-2 on a side whose temperature is lower than 160° C. by the first control method A.

That is, it is continuously monitored in steps S11 and S12 whether or not the temperature of any region of the roller 2 is lower than 160° C. It is to be noted that a power which is 1/n of a power at the warming-up time to a power equal to that supplied at the warming-up time is supplied to a coil on a temperature drop side in a case where the surface of the roller 2 in the position facing the individual thermistors 6*a*, 6*b* is at the temperature lower than 160° C.

In this control method, since the power is supplied to either coil, interference sound caused by the difference of the driving frequency is not generated. It is to be noted that in many cases, the magnitude of the interference sound raises a problem at a standby time (during the ready state) when a comparatively large sound does not exist (is not generated) by the operation of an image forming device main body unlike the warming-up time or an image forming time. Therefore, the first control method A is a preferable control method in the ready state.

Here, an influence will be considered in a case where the powers that can be supplied to the respective coils (set) 12*a*, 12-1, and 12-2 and the first control method A are applied to the ready state. An output range of the coil 12*a*, or the coil set of 12-1, 12-2 is 100 to 600 W, and a minimum output is 100 W. Therefore, as compared with a power consumption (200 W) in a case where the simultaneous driving (second control method B) is continued, the power consumption can be apparently reduced.

However, when the power is supplied to either of the coil 12*a* and the set of coils 12-1, 12-2, it is difficult to avoid a temperature difference made in the longitudinal direction of the roller 2. On the other hand, in the ready state, even with a certain temperature difference made in the longitudinal direction of the roller 2, it can be naturally considered that there is a merit by the reduction of the power consumption, if the temperature difference in the longitudinal direction of the roller 2 can be eliminated from when the image forming is next directed until the sheet is conveyed into the fixing device.

Figure 11A:
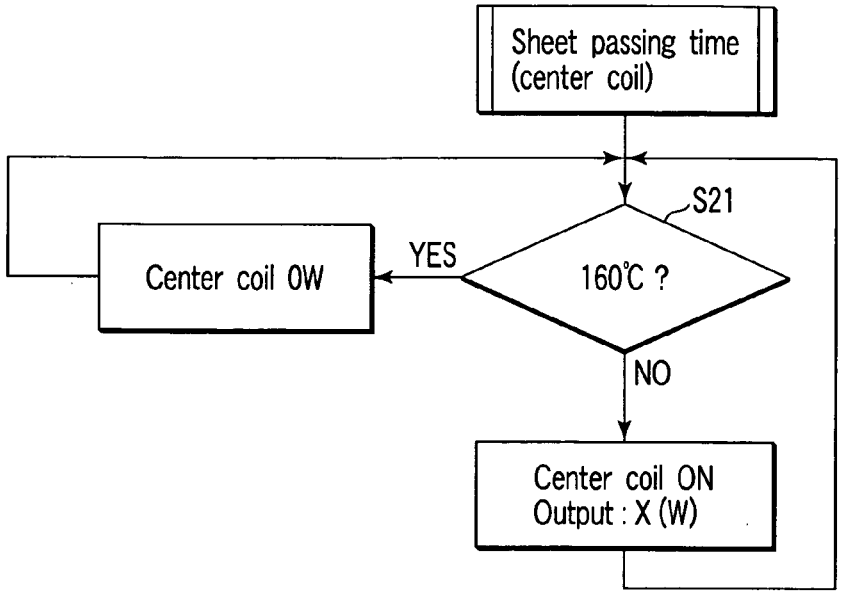
FIGS. 11A and 11B are schematic diagrams showing an example of the power supply control capable of reducing the interference sound in the fixing device shown in FIG. 8 (at a fixing operation time)
Figure 11B:
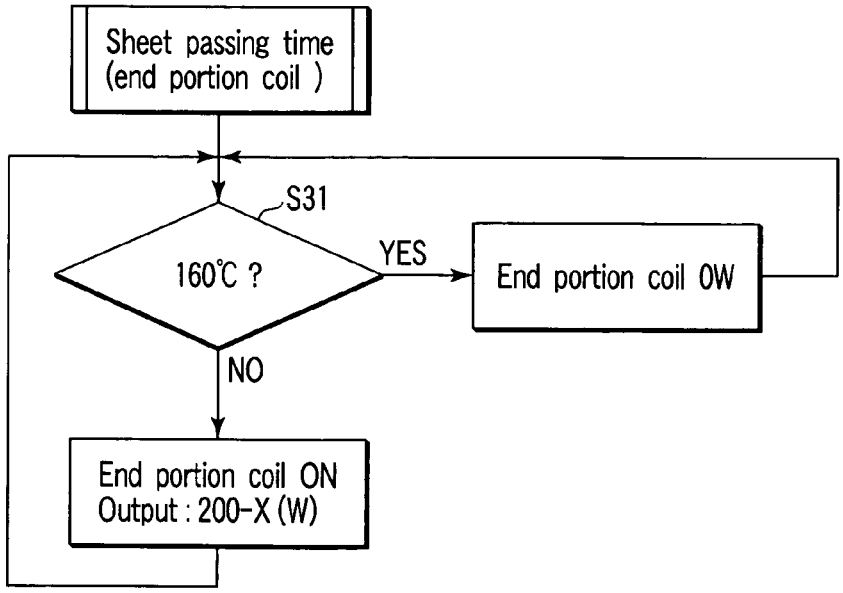

FIGS. 11A and 11B show an example of power conduction control during an image forming operation.

Basically, the control is substantially similar to that during the warming-up. In this case, it is assumed that the outputs (powers) supplied to all the coils is about 800 W in total. It is to be noted that the output more preferably changes based on the number of output sheets (number of image forming times) or the type of paper.

In more detail, the temperature of the region of the roller 2 facing the coil 12*a* and the coil set 12-1, 12-2 is detected independently in steps S21 and S31. When the temperature of the roller 2 is below 160° C., a predetermined power is supplied to the coil of the corresponding region. It is to be noted that when the temperature difference is larger than a defined value in the longitudinal direction of the roller 2, the output supplied to the center coil 12*a* may be set separately from the output supplied to the end portion coils (pair) 12-1, 12-2. For example, the A4 size sheet is conveyed so that the short side of the sheet is directed to cross a sheet conveying direction at right angles. In this case, the temperature drop of the region of the roller 2 in which the heat is generated by the end portion coils (pair) 12-1, 12-2 is smaller than that of the region where the heat is generated by the center coil 12*a*. That is, the output supplied to the end portion coils 12-1, 12-2 is preferably limited to be smaller than the output supplied to the center coil 12*a*.

It is to be noted that the total of the outputs supplied to the center coil 12*a* and the end portion coils (pair) 12-1, 12-2 is preferably substantially constant as described above.

In this case, it is considered that the interference sound is generated by the difference of the frequency of the output supplied to the coil, that is, the power. However, as described above with reference to FIG. 8, since the sound absorbing materials 231, sound insulating walls 241, resin cover and the like are disposed, the sound is suppressed to the magnitude of the device operation sound generated from the image forming device.

Therefore, the problem caused by the magnitude of the interference sound generated by the frequency difference between the powers (inverter outputs) having different frequencies, supplied to the divided coils, can be substantially solved without increasing the cost of the driving circuit (inverter circuit).

Figure 12:
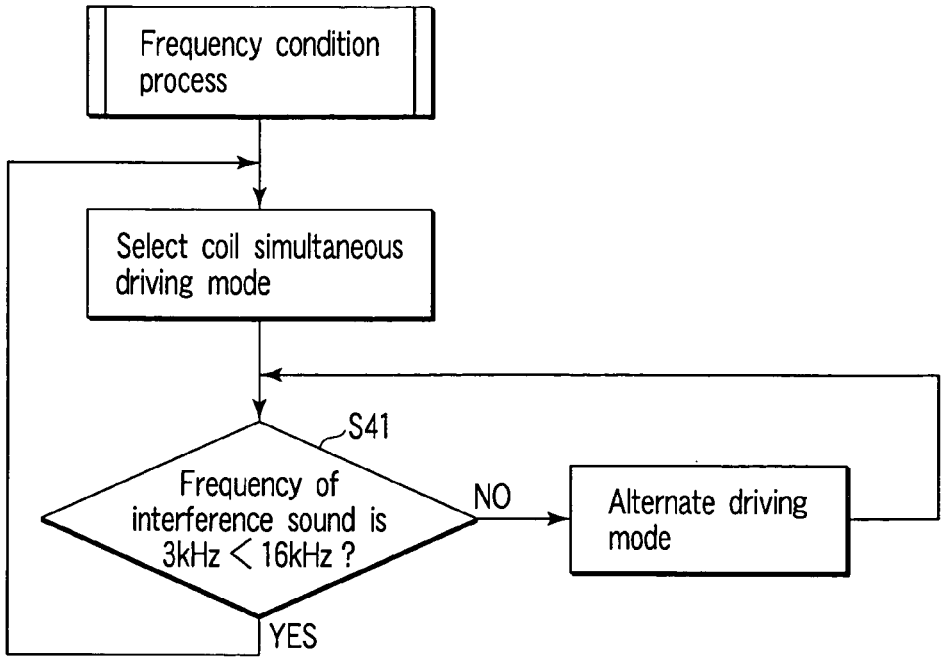
FIG. 12 is a schematic diagram showing an example of power supply (power conduction control) separated from power conduction control into coils shown in FIGS. 9, 10, 11A, and 11B (audio frequency tackling control)

FIG. 12 shows an example of power supply (power conduction control) separate from power conduction control into the coils shown in FIGS. 9, 10, 11A, and 11B.

In the power control shown in FIG. 12, the control method is changed using the frequencies of the powers (outputs) supplied to the coil 12*a* and the coil pair 12-1, 12-2 as the conditions.

In detail, usually, the coil current for the temperature required for the roller 2 is controlled to obtain an optimum value of output at an appropriate time by the first control method A (alternate) or the second control method B (simultaneous) described above.

However, it is detected in step S41 that the difference of the frequencies of the powers required for the respective coils approaches the frequency generating an interference sound of a audio range. In this case, the powers having the equal frequency are supplied to all the coils. For example, as described with reference to FIGS. 11A and 11B, the A4 size sheet is conveyed in such a manner that the short side of the sheet is directed to cross the sheet conveying direction at right angles. In this case, when the number of sheets, that is, the number of continuous image forming times increases, the difference of the power required for the opposite end portion coils 12-1, 12-2 from the output to be supplied to the center coil 12*a* increases (the heat generated substantially in the middle of the roller 2 by the supply of the power to the center coil 12*a* is transmitted to the end portion of the roller 2 by heat conduction in many cases). This is remarkable when the amount of continuously formed image output increases. Under this condition, as described with reference to FIGS. 11A and 11B, since the heat is generated in the vicinity of the middle of the heating roller 2 by the first control method A (alternate), the output supplied to the coil 12*a* is larger than that supplied to the end portion coils 12-1, 12-2, and the interference sound in the audio range is generated. It is to be noted that the audible range is, for example, 3 kHz to 16 kHz. Additionally, needless to say, the numerical value of the interference sound of the audio range changes in accordance with the degree of sound absorption or attenuation by the sound insulating walls 241 or the sound absorbing materials 231 shown in FIG. 8.

Therefore, when the difference between the frequencies of the powers supplied to the coil 12*a* and the coil pair 12-1, 12-2 reaches a level having a possibility of the interference sound in the audio range, in step S41, the process is preferably switched to the simultaneous driving (second control method B). When the temperature difference of the longitudinal direction of the roller 2 is reduced and the frequency difference is outside the audible range, the process may also be switched to the alternate driving (first control method A) again in accordance with an operation state of the image forming device.

Figure 13:
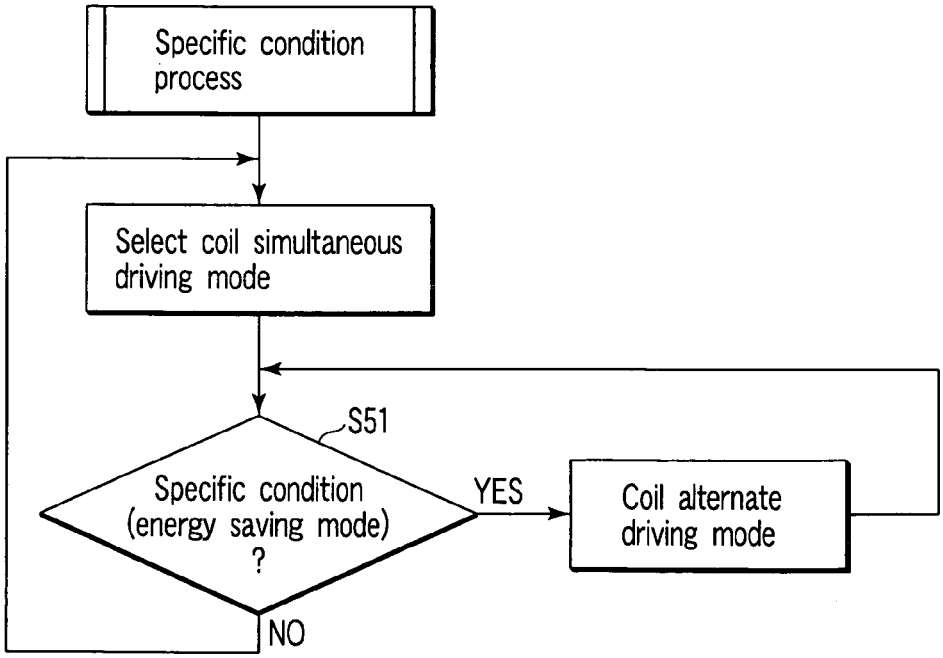
FIG. 13 is a schematic diagram showing an example of the power supply (power conduction control) further separated from the power conduction control into the coils shown in FIGS. 9, 10, 11A, and 11B (temperature condition tackling control).

FIG. 13 shows an example of the power supply (power conduction control) further separate from the power conduction control into the coils shown in FIGS. 9, 10, 11A, and 11B.

For example, in the control at a usual control temperature or less (e.g., 100° C.) as in an energy saving mode, alternate driving is constantly performed. That is, as shown in FIG. 13, the temperature is different from 160° C. which is a usual control temperature, and powers having different frequencies are supplied to the individual coils by the alternate driving (first control method A). Even in this case, it can be specified in step S51 that the frequency substantially having no possibility of generation of the interference sound is apparently used for reasons such as the suppression of coil output. In this case, the first control method A capable of reducing the power consumption may also be used.

When the temperature of the roller 2 in the longitudinal direction is uniformly controlled in this manner, and when it is recognized that the difference between the frequencies of the driving powers supplied to the coils 12*a*, 12-1, and 12-2 is made under a specific condition and that the interference sound is generated, the alternate driving (first control method A) is switched to the simultaneous driving (second control method B), the magnitude (level) of the interference sound can be prevented from raising any problem.

It is to be noted that in the above-described various embodiments, an example in which the inverter circuit is of a self-exciting type including one switching element has been described. However, it is also possible to apply the present invention to the inverter circuit in which the interference sound of a half bridge circuit or the like is not substantially made.

Moreover, in the present embodiment, an example in which two (two sets of) coils are disposed along the axial direction of the heating roller 2 has been described, but the number of coils may be optionally set, and, for example, three or more sets of coils (three or more coils) may also be used.

As described above, a heating device of the present invention is capable of efficiently converting a magnetic field supplied to a conductive layer to heat. The heating device of the present invention is capable of reducing a loss of energy (magnetic field) which is not used for generating the heat in the conductive layer.

By the application of the heating device of the present invention to a fixing device, the power consumption (magnetic field generation amount) can be reduced, while the time required for raising the temperature of the heating object to a fixable temperature can be reduced. Furthermore, a fixing property of the image formed on the recording material can be enhanced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A heating device comprising:

a body to be heated to which a magnetic field is supplied to generate heat and which heats a developer on a material to be recorded;

first and second coil bodies which generate an induced heat in the body to be heated from the outside of the body to be heated, a plurality of first and second coil bodies being disposed in a longitudinal direction of the body to be heated, the first and second coil bodies including litz wires whose cross sections are formed in rectangular shapes; and a pressure applying member which contacts the body to be heated in a predetermined position and which fixes the developer on the material to be recorded passing between the pressure applying member and the body to be heated wherein the sizes of sectional shapes of the litz wires of the first and second coil bodies in a direction distant from a center of the body to be heated are smaller than those extending along the peripheral surface crossing the center of the body to be heated at right angles.

2. The heating device according to claim 1, wherein the sizes of the first and second coil bodies in a direction distant from a center of the body to be heated are larger than those extending along the peripheral surface crossing the center of the body to be heated at right angles.

3. The heating device according to claim 1, wherein the litz wires of the first and second coil bodies are laminated in a normal direction of a peripheral surface crossing the center of the body to be heated at right angles.

4. The heating device according to claim 1, wherein the litz wires of the first and second coil bodies are laminated parallel to a segment directed toward the peripheral surface from the center of the body to be heated.

5. The heating device according to claim 4, wherein the litz wires of the first and second coil bodies are deformed toward the peripheral surface from a segment in a state in which the litz wires are laminated in parallel with the segment directed toward the peripheral surface from the center of the body to be heated.

6. The heating device according to claim 4, wherein the litz wires of the first and second coil bodies are deformed along the peripheral surface from a segment in a state in which the litz wires are laminated parallel to the segment directed toward the peripheral surface from the center of the body to be heated.

7. A heating device comprising:

a body to be heated to which a magnetic field is supplied to generate heat and which heats a developer on a material to be recorded;

first and second coil bodies which generate an induced heat in the body to be heated from the outside of the body to be heated, a plurality of first and second coil bodies being disposed in a longitudinal direction of the body to be heated, the first and second coil bodies including litz wire comprising a plurality of intertwined wires;

a pressure applying member which contacts the body to be heated in a predetermined position and which fixes the developer on the material to be recorded passing between the pressure applying member and the body to be heated;

a housing with which at least a part of the body to be heated is covered;

a second housing with which at least a part of the pressure applying member is covered;

sound absorbing materials which are disposed in predetermined positions of the housing and the second housing and which absorb sound generated in a case where driving signals having different frequencies are supplied to the first and second coil bodies; and a sound insulating member which is disposed in a predetermined position of at least one of the housing and the second housing and which attenuates sound generated in a case where the driving signals having different frequencies are supplied to the first and second coil bodies.

8. The heating device according to claim 7, wherein the first and second coil bodies are disposed along a longitudinal direction of the body to be heated, the first coil body is position in a middle of the longitudinal direction of the body to be heated, and the second coil body is electrically connected to the first coil body and extends along the longitudinal direction of the body to be heated and is positioned in ends of the body to be heated in the longitudinal direction on opposite sides of the first coil body.

9. The heating device according to claim 8, wherein the first and second coil bodies supply a magnetic field having a predetermined magnitude to the body to be heated based on either of a first control mode in which a driving signal is alternately supplied to the first and second coil bodies and a second control mode in which the driving signal is simultaneously supplied to the first and second coil bodies.

10. The heating device according to claim 9, wherein the first and second coil bodies are operated in the second control mode at a warming-up operation time when the body to be heated is heated at a predetermined temperature.

11. The heating device according to claim 9, wherein the first and second coil bodies are operated in the first control mode at a standby operation time after the body to be heated is heated at a predetermined temperature.

12. The heating device according to claim 9, wherein the first and second coil bodies are operated in the second control mode at a fixing operation time when the material to be recorded is passed between the body to be heated and the pressure applying member.

13. The heating device according to claim 12, wherein the first and second coil bodies are operated in either of the second control mode and the first operation mode in accordance with a length of the material to be recorded along the longitudinal direction of the body to be heated and the number of passing times of the material to be recorded at a fixing operation time when the material to be recorded is passed between the body to be heated and the pressure applying member.

14. The heating device according to claim 9, wherein the first and second coil bodies are operated in either of the second control mode and the first operation mode in accordance with device component of a sound generated in a case where driving signals having different frequencies are supplied to the first and second coil bodies based on a temperature drop condition caused by the number of passing times of the material to be recorded and a length of the material to be recorded along the longitudinal direction of the body to be heated at a fixing operation time when the material to be recorded is passed between the body to be heated and the pressure applying member.

15. The heating device according to claim 9, wherein the first and second coil bodies are operated in the first operation mode on a condition that a magnitude of a sound generated in a case where driving signals having different frequencies are supplied to the first and second coil bodies is smaller than that of a sound generated in and around the heating device in a case where an operation is directed on a condition different from that at a fixing operation time when the material to be recorded is passed between the body to be heated and the pressure applying member.

16. A fixing device comprising:

a body to be heated including a central axis, an elastic body formed in a predetermined thickness around the central axis, a conductive layer formed in a predetermined thickness around the elastic body, and a second elastic body formed in a predetermined thickness around the conductive layer to generate heat by supply of a magnetic field, so that a developer on a material to be recorded is heated;

first and second coil bodies to supply predetermined magnetic fields so that the conductive layer of the body to be heated is capable of generating heat from the outside of the body to be heated, a plurality of first and second coil bodies being disposed in a longitudinal direction of the body to be heated, the first and second coil bodies including litz wires whose cross sections are formed in rectangular shapes;

a pressurizing member which is disposed along the central axis of the body to be heated and which supplies a pressure toward the central axis or a predetermined position of the body to be heated to deform the elastic body by a predetermined amount;

a housing with which at least a part of the body to be heated is covered;

a second housing with which at least a part of the pressurizing member is covered;

sound absorbing materials which are disposed in predetermined positions of the housing and the second housing and which absorb sound generated in a case where driving signals having different frequencies are supplied to the first and second coil bodies; and a sound insulating member which is disposed in a predetermined position of at least one of the housing and the second housing and which attenuates sound generated in a case where the driving signals having different frequencies are supplied to the first and second coil bodies.

* * * * *